US011910873B2

(12) United States Patent
Blanchard et al.

(10) Patent No.: US 11,910,873 B2
(45) Date of Patent: Feb. 27, 2024

(54) METHODS OF FORMING AN ARTICLE OF FOOTWEAR WITH A MULTIPART STROBEL STRUCTURE AND ARTICLES FORMED BY THE SAME

(71) Applicant: NIKE, Inc., Beaverton, OR (US)

(72) Inventors: Philippe Blanchard, Beaverton, OR (US); Dongwoo Lee, Busan (KR); Anthony S. Miller, Portland, OR (US); SunHo Lee, Anyang-si (KR); YooChang Song, Gyeongsangnam-do (KR); Ilgwan Yeo, Busan (KR)

(73) Assignee: NIKE, Inc., Beaverton, OR (US)

( * ) Notice: Subject to any disclaimer, the term of this patent is extended or adjusted under 35 U.S.C. 154(b) by 455 days.

(21) Appl. No.: 16/857,113

(22) Filed: Apr. 23, 2020

(65) Prior Publication Data

US 2020/0337417 A1 Oct. 29, 2020

Related U.S. Application Data

(60) Provisional application No. 62/839,574, filed on Apr. 26, 2019.

(51) Int. Cl.
*A43B 23/22* (2006.01)
*A43D 25/047* (2006.01)
(Continued)

(52) U.S. Cl.
CPC ..... *A43B 23/222* (2013.01); *A43D 25/047* (2013.01); *A43B 3/244* (2013.01);
(Continued)

(58) Field of Classification Search
CPC ..... A43B 23/222; A43B 17/18; A43B 15/00; A43B 3/244; A43D 25/047; A43D 11/006; A43D 11/01; A43D 11/02
(Continued)

(56) References Cited

U.S. PATENT DOCUMENTS 1,714,271 A * 5/1929 Kelly ..... A43B 13/38 12/142 B
1,741,999 A * 12/1929 May ..... A43B 13/383 36/76 R
(Continued)

FOREIGN PATENT DOCUMENTS

CN 1372441 A 10/2002
CN 2712123 Y 7/2005
(Continued)

OTHER PUBLICATIONS

International Search Report and Written Opinion, dated Jun. 18, 2020, issued for International Application No. PCT/US2020/027992, 13 pages.

*Primary Examiner* — Timothy K Trieu
*Assistant Examiner* — Dakota Marin
(74) *Attorney, Agent, or Firm* — Klarquist Sparkman, LLP

(57) ABSTRACT

Methods of forming an article of footwear using a multipart strobel structure and a resulting article of footwear comprising an upper with a transition strip are described. The transition strip that has an outer perimeter edge, an inner perimeter edge, and a width between the outer perimeter edge and the inner perimeter edge, with the inner perimeter edge defining an internal opening of the transition strip, and the inner strobel that has an outer perimeter edge. The inner strobel is positioned in an overlapping relationship with the transition strip and temporarily attached.

17 Claims, 14 Drawing Sheets

(51) Int. Cl.

| | |
|---|---|
| *A43B 3/24* | (2006.01) |
| *A43B 15/00* | (2006.01) |
| *A43B 17/18* | (2006.01) |
| *A43D 11/00* | (2006.01) |
| *A43D 11/01* | (2006.01) |
| *A43D 11/02* | (2006.01) |

(52) U.S. Cl.
CPC ..... *A43B 15/00* (2013.01); *A43B 17/18* (2013.01); *A43D 11/006* (2013.01); *A43D 11/01* (2013.01); *A43D 11/02* (2013.01)

(58) Field of Classification Search
USPC ..... 36/15, 17 R; 12/142 R, 4.1, 112
See application file for complete search history.

(56) References Cited

U.S. PATENT DOCUMENTS

| | | | | | |
|---|---|---|---|---|---|
| 2,044,875 | A * | 6/1936 | Cavanagh | A43B 9/02 | 12/142 F |
| 2,183,277 | A * | 12/1939 | Heilhecker | A43B 13/28 | 36/15 |
| 2,313,902 | A * | 3/1943 | Turner | A43D 25/06 | 36/16 |
| 2,427,798 | A * | 9/1947 | Maling | A43B 9/14 | 36/12 |
| 2,460,097 | A * | 1/1949 | Maling | A43B 9/14 | 36/11 |
| 3,345,663 | A | 10/1967 | Batchelder et al. | | |
| 3,530,597 | A * | 9/1970 | Rubico | A43B 3/14 | 12/142 MC |
| 3,552,041 | A * | 1/1971 | Batchelder et al. | A43B 9/12 | 36/43 |
| 4,267,650 | A * | 5/1981 | Bauer | A43B 3/24 | 36/15 |
| 4,969,224 | A * | 11/1990 | Birke | A43B 9/125 | 12/142 F |
| 6,427,363 | B1 * | 8/2002 | Hunter | A43B 3/24 | 36/15 |
| 6,662,469 | B2 * | 12/2003 | Belley | A43B 13/16 | 36/19 R |
| 7,984,569 | B2 * | 7/2011 | Chaney | A43B 13/24 | 36/15 |
| 7,987,617 | B2 * | 8/2011 | Kohatsu | A43D 111/00 | 36/15 |
| 8,051,581 | B2 * | 11/2011 | Aveni | A43B 3/103 | 36/11 |
| 10,524,542 | B2 * | 1/2020 | Avar | A43B 23/0275 | |
| 2002/0178612 | A1 * | 12/2002 | Tsen | A43B 13/28 | 36/14 |
| 2002/0178614 | A1 * | 12/2002 | Issler | A43B 17/00 | 36/43 |
| 2012/0023686 | A1 | 2/2012 | Huffa et al. | | |
| 2013/0167405 | A1 * | 7/2013 | Forsey | A43B 7/1464 | 12/142 R |
| 2015/0257487 | A1 | 9/2015 | Ruiz et al. | | |
| 2015/0374070 | A1 * | 12/2015 | Tawney | A43B 1/14 | 36/87 |
| 2016/0007681 | A1 | 1/2016 | Langvin | | |
| 2016/0029739 | A1 * | 2/2016 | Dias | A43B 13/187 | 36/15 |
| 2016/0302517 | A1 | 10/2016 | Jessiman et al. | | |
| 2018/0213886 | A1 * | 8/2018 | Connell | A43B 13/186 | |
| 2018/0271214 | A1 | 9/2018 | Farris et al. | | |
| 2019/0045880 | A1 | 2/2019 | Li et al. | | |

FOREIGN PATENT DOCUMENTS

| | | | |
|---|---|---|---|
| CN | 201051898 | Y | 4/2008 |
| CN | 103153110 | A | 6/2013 |
| CN | 104619209 | A | 5/2015 |
| CN | 104754973 | A | 7/2015 |
| CN | 106455744 | A | 2/2017 |
| CN | 106455748 | A | 2/2017 |
| EP | 3155918 | A1 | 4/2017 |
| GB | 190925198 | A | 10/1910 |

* cited by examiner

METHODS OF FORMING AN ARTICLE OF FOOTWEAR WITH A MULTIPART STROBEL STRUCTURE AND ARTICLES FORMED BY THE SAME

CROSS REFERENCE TO RELATED APPLICATION

This application claims the benefit of U.S. Provisional Patent Application No. 62/839,574, filed Apr. 26, 2019, which is incorporated herein by reference in its entirety.

FIELD

This disclosure is directed to articles of footwear and methods of manufacturing articles of footwear, and, in particular, to articles of footwear with removable strobels and methods for forming the same.

SUMMARY

The foregoing and other objects, features, and advantages of the invention will become more apparent from the following detailed description, which proceeds with reference to the accompanying figures.

DETAILED DESCRIPTION

General Considerations

Figure 1:
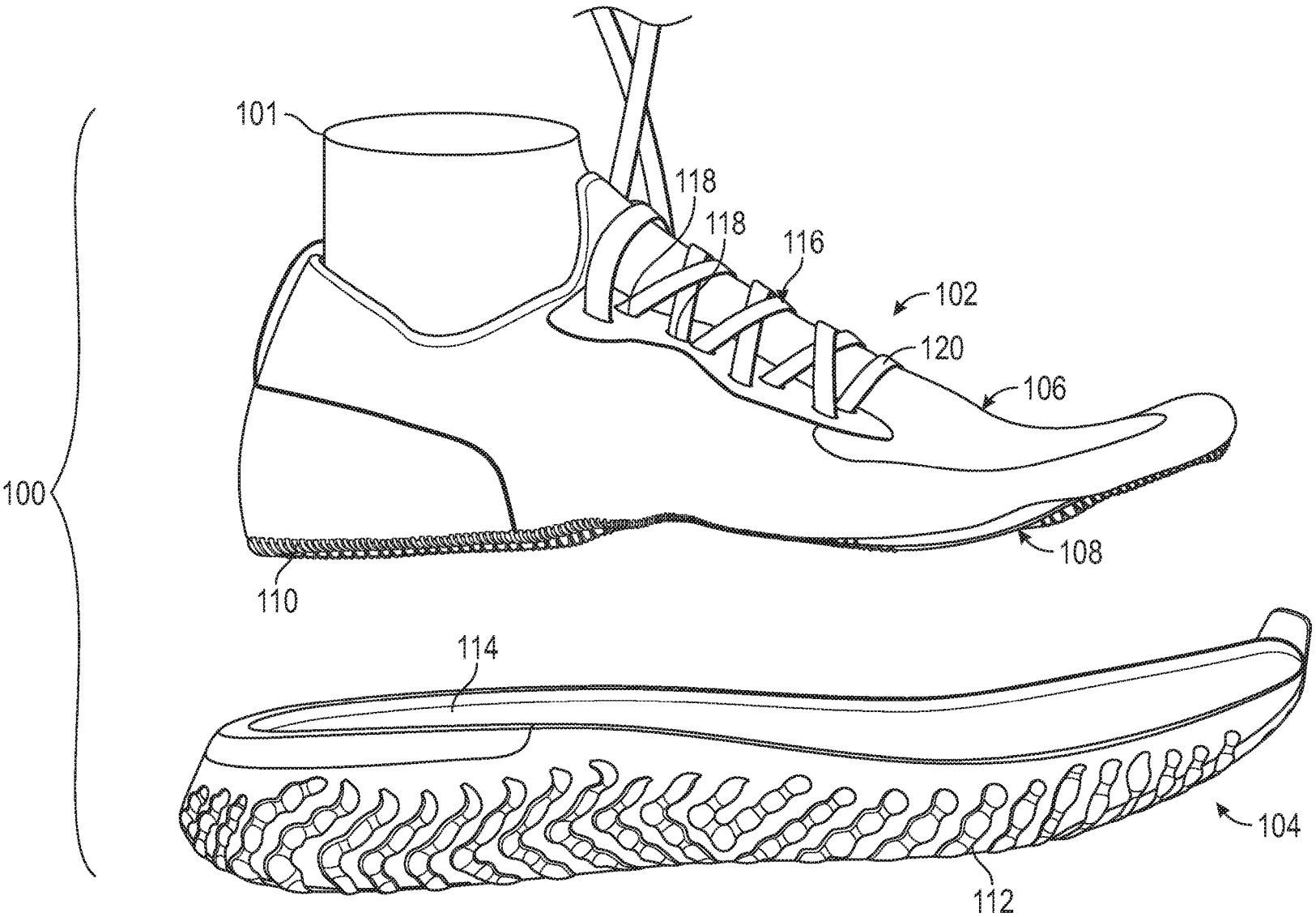
FIG. 1 illustrates an article of footwear that includes a lasted upper and a sole structure.

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body."

"Longitudinal axis" refers to a centerline of the article from the heel to toe. Similarly, a "longitudinal length" refers to a length of the article along the longitudinal axis and a "longitudinal direction" refers to a direction along the longitudinal axis.

As used herein, the term "strobel structure" refers to a structure that is attached along its border to a body of an upper to form a "lasted upper." The term "multipart strobel structure" refers to a strobel structure that comprises two or more discrete structures that can be brought together and temporarily attached and, subsequently, separated from one another.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the term "fixedly attached" refers to two components joined in a manner such that the components may not be readily separated from one another without destroying and/or damaging one or both of the components. Exemplary modalities of fixed attachment may include joining with permanent adhesive, stitches, welding or other thermal bonding, and/or other joining techniques. In addition, two components may be "fixedly attached" by virtue of being integrally formed, for example, in a molding process. In contrast, the term "temporarily attached," or "temporarily fixed," refers to two components joined in a manner such that the components can be readily separated from one another to return to their separate, discrete forms without destroying and/or damaging either component. Exemplary modalities of temporary attachment may include removable stitches or other temporary joining techniques.

Although the figures may illustrate an article of footwear intended for use on only one foot (e.g., a right foot) of a wearer. One skilled in the art will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

The Disclosed Technology

Various methods of forming an article of footwear using a multipart strobel structure and resulting articles of footwear comprising an upper with a transition strip are described herein.

In one implementation, an exemplary method of forming of an article of footwear includes providing a transition strip and an inner strobel. The transition strip has an outer perimeter edge, an inner perimeter edge, and a width between the outer perimeter edge and the inner perimeter edge, with the inner perimeter edge defining an internal opening of the transition strip. The inner strobel has an outer perimeter edge. The inner strobel is positioned in an overlapping relationship with the transition strip to provide an overlapping region between the outer perimeter edge of the inner strobel and the inner perimeter edge of the transition strip, and a non-overlapping region that extends from an outside boundary of the overlapping region to the outer perimeter edge of the transition strip. The inner strobel is temporarily attached to the transition strip at the overlapping region and the transition strip is secured to a bottom portion of an upper. The transition strip is attached to the upper at the non-overlapping region and with the inner strobel facing an inner portion of the upper. The transition strip and bottom portion of the upper are fixedly attached to a sole structure, and the inner strobel is subsequently separated and removed from the transition strip.

In some embodiments, the transition strip has a first width at a first location along its length and the overlapping region has a second width at the first location, and a ratio of the second width to the first width is between 0.25 and 0.85, or between 0.30 and 0.50. The width of the transition strip can be substantially constant along a length of the transition strip or it can vary. In some embodiments, the width of the transition strip is between 6 mm and 15 mm, between 8 and 13 mm, or between 10.5 and 12 mm.

The inner strobel can be temporarily attached to the transition strip with one or more threads using a removable stitch, such as a chain stitch, and subsequently separated from the transition strip by removing the thread(s) from the inner strobel. In some embodiments, the inner strobel and the transition strip can be formed of a generally non-stretchable material.

The transition strip can be secured to the bottom portion of the upper by stitching the bottom portion of the upper to an area adjacent the outer perimeter edge of the transition strip and, fixedly attaching the transition strip and bottom portion of the upper to the sole structure can include applying a bonding material at an attachment area and contacting the bonding material with an upper surface of the sole structure to secure the upper and the transition strip to the sole structure. The attachment area can include a location where the transition strip is secured to a bottom portion of an upper and exclude an area of the overlapping region where the inner strobel is temporarily attached the transition strip.

In another implementation, an article of footwear is provided that includes an upper, a transition strip, and a sole structure with an upper surface and a ground-contacting surface opposite the upper surface. The transition strip has an outer perimeter edge, an inner perimeter edge, and a width between the outer perimeter edge and the inner perimeter edge, with the inner perimeter edge defining an internal opening of the transition strip. The upper surface of the sole structure has a perimeter portion that extends along a perimeter of the upper surface and an internal portion that is surrounded by the perimeter portion. The transition strip is secured to a bottom portion of the upper along a lower perimeter edge. The lower perimeter edge of the upper and the transition strip are secured to the perimeter portion of the upper surface of the sole structure with the inner perimeter edge of the transition strip defining an inner boundary of the perimeter portion. The internal portion of the upper surface of the sole structure is exposed by the internal opening of the transition strip.

In some embodiments, the width of the transition strip can be substantially constant along a length of the transition strip, or it can vary. The width of the transition strip can be between 6 mm and 15 mm, between 8 and 13 mm, or between 10.5 and 12 mm. In some embodiments, the transition strip comprises stitch holes adjacent the inner perimeter edge from a removable stitch. The transition strip can be a generally non-stretchable material.

In some embodiments, the transition strip is secured to the bottom portion of the upper by stitching the bottom portion of the upper to an area adjacent the outer perimeter edge of the transition strip, and the lower perimeter edge of the upper and the transition strip are secured to the perimeter portion of the upper surface of the sole structure by a bonding material.

The article of footwear can include a sockliner, with a bottom surface of the sockliner being in contact with at least a portion of an upper surface of the transition strip and the exposed internal portion of the upper surface of the sole structure.

In another implementation, A method of forming of a multipart strobel structure can include providing a transition strip and an inner strobel. The transition strip has an outer perimeter edge, an inner perimeter edge, and a width between the outer perimeter edge and the inner perimeter edge, with the inner perimeter edge defining an internal opening of the transition strip. The inner strobel that has an outer perimeter edge and is positioned in an overlapping relationship with the transition strip to provide an overlapping region between the outer perimeter edge of the inner strobel and the inner perimeter edge of the transition strip. A non-overlapping region that extends from an outside boundary of the overlapping region to the outer perimeter edge of the transition strip. The inner strobel is temporarily attached to the transition strip at the overlapping region. Additional details of the transition strip and inner strobel are noted above and discussed in more detail herein.

Exemplary Embodiments of the Disclosed Technology

Figure 2:
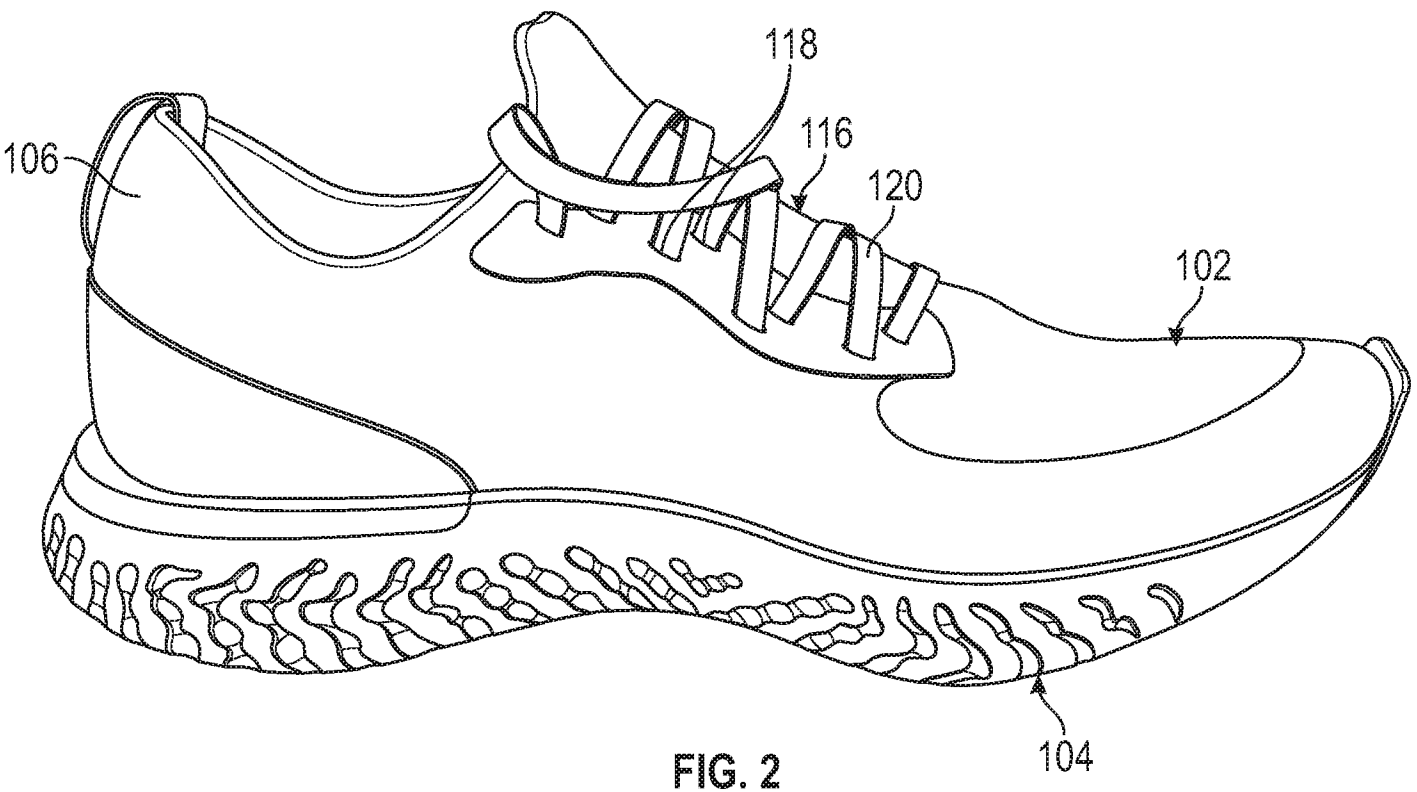
FIG. 2 illustrates the article of footwear of FIG. 1, with the lasted upper coupled to the sole structure.

FIG. 1 illustrates an article of footwear 100 that comprises an upper 102 on a last 101, with a sole structure 104 adjacent the upper 102 for application thereto. The lasted upper 102 includes an upper 106 and a strobel structure 108 that is attached to a lower perimeter of the upper 106, such as by stitching 110. Sole structure 104 has a lower surface 112 (e.g., a ground contacting surface) and an upper surface 114. Although sole structure 104 is illustrated as a single structure in the embodiments that follow, other types of sole structures can be used, such as, for example, any combination of an outsole, midsole, and inner sole. As shown in FIG. 2, after a lower surface of the lasted upper 102 is coupled to the upper surface 114 of the sole structure 104, the article of footwear 100 can be removed from the last 101.

A last, such as last 101, is a tool form about which an article of footwear can be constructed and which, at least in part, can define the contours, shape, style, and other characteristics of a resulting article of footwear. For example, an interior volume of the lasted upper 102 is received on last 101 for further processing, such as adding the sole structure 104 discussed above or some other component.

Upper 106 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. The upper 106 shown in FIG. 1 includes a lacing region 116, which includes apertures 118 (e.g., eyelets) for receiving a lace 120 that can be tightened to close the upper around a foot. Upper 106 may alternatively implement any of a variety of other configurations, materials, and/or closure mechanisms.

Figure 3:
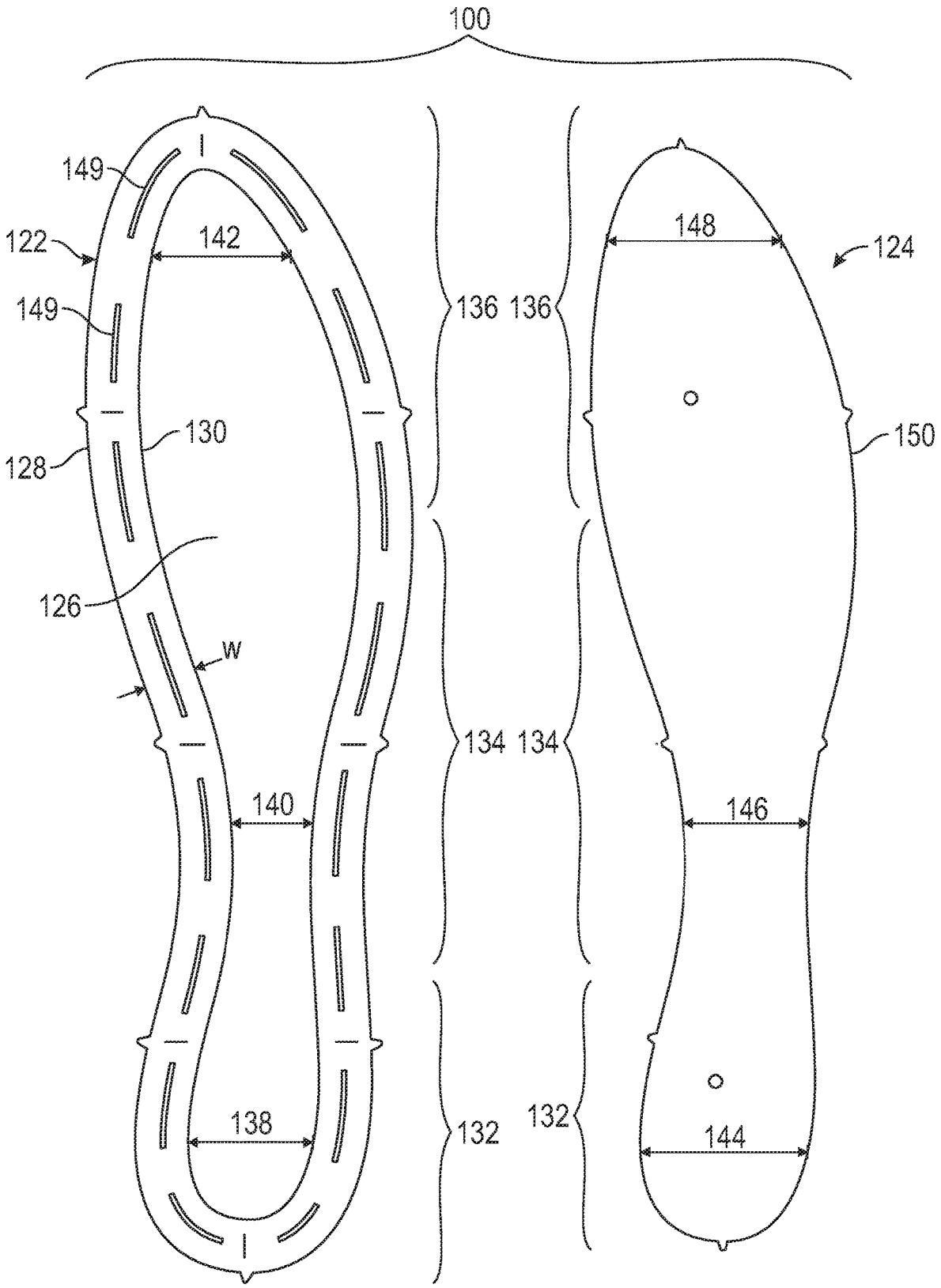
FIG. 3 illustrates an exemplary multipart strobel structure that includes a transition strip and an inner strobel.

FIG. 3. illustrates an exemplary multipart strobel structure 108. Strobel structure 108 comprises a transition strip 122 and an inner strobel 124. Transition strip 122 and inner strobel 124 can be formed from a flexible material, such as woven materials, non-woven materials, knit materials, or a combination thereof. Alternatively, one or both of transition strip 122 and inner strobel 124 can be formed, at least in part, by more rigid materials so long as the materials can be temporarily fixed together as described in more detail below. Transition strip 122 and inner strobel 124 can be formed of the same or different materials.

In some embodiments, transition strip 122 and inner strobel 124 are formed of a generally non-stretchable material to provide improved structural integrity to the lasted upper during manufacturing. As used herein, the term "non-stretchable material" refers to a material with no elastic components such that the material will not stretch more than 5% in either the length or width direction under the forces applied during lasting. For determining whether an amount of stretch is less than 5%, ASTM D6614 can be used.

Transition strip 122 is a closed strip of material that is sized to correspond to a desired perimeter of a lower surface of an upper and defines an internal opening 126. Transition strip 122 has an outer perimeter edge 128, an inner perimeter edge 130, and a width w defined by a distance between the outer perimeter edge 128 and the inner perimeter edge 130. In some embodiments, the width w of the transition strip 122 can be between 6 mm and 15 mm, between 8 and 13 mm, between 8 and 12.5 mm, or, in other embodiments, between 10.5 and 12 mm. The width w of the transition strip 122 can be substantially constant along the entire length of the transition strip 122 or, alternatively, it can vary if desired. For example, if desired, the width w can be greater in a heel region 132 than in a midfoot region 134, and/or greater in a forefoot region 136 than the heel region 132. In some embodiments, the width w of the transition strip 122 does not vary more than 10% along its entire length. As used herein, "substantially constant" means that the width does not vary by more than 5% along the entire length of the transition strip 122. In addition, a width w of a transition strip that varies from 10.5 mm to 12 mm is a width that is between 10.5 mm and 12 mm, since the end points of the range are included.

Internal opening 126 has a width that varies along the longitudinal axis of the transition strip 122. Thus, for example, a width 138 of the internal opening 126 at the heel region 132 can be different than a width 140 at the midfoot region 134 and a width 142 at the forefoot region.

Inner strobel 124 can have a shape that generally corresponds to the shape of the internal opening 126; however, inner strobel 124 is larger than the internal opening 126 so that when inner strobel 124 is aligned with the internal opening 126 (e.g., with inner strobel 124 on top of the transition strip 122), a portion of the inner strobel 124 overlaps with the transition strip 122.

For example, as shown in FIG. 3, inner strobel 124 also has a width that varies along its longitudinal axis; however, a width 144 of the inner strobel 124 at the heel region 132 is greater than the width 138 of the internal opening 126 at a corresponding area of the heel region, a width 146 of the inner strobel 124 at the midfoot region 134 is greater than the width 140 of the internal opening 126 at a corresponding area of the midfoot region 134, and a width 148 of the inner strobel 124 at the forefoot region 136 is greater than the width 142 of the internal opening 126 at a corresponding area of the forefoot region 136. Thus, when the inner strobel 124 is positioned in alignment over the internal opening 126, at least a portion of an outer edge 150 of the inner strobel 124 overlaps with the inner perimeter edge 130 of the transition strip 122. The transition strip 122 of FIG. 3 has a plurality of gauge marks 149 that illustrate an exemplary alignment location for the outer edge 150 of the transition strip 122.

Since the transition strip 122 remains in the article of footwear after construction, as described herein, the transition strip desirably has a relatively low profile. For example, in some embodiments, the thickness of the transition strip ($T_1$ in FIG. 12) is less than or equal to 1.2 mm, less than or equal to 1.0 mm, or less than or equal to 0.8 mm. The inner strobel can have the same thickness as the transition strip. However, since the inner strobel is removed after construction, it can have a greater thickness than the transition strip if desired.

Figure 4:
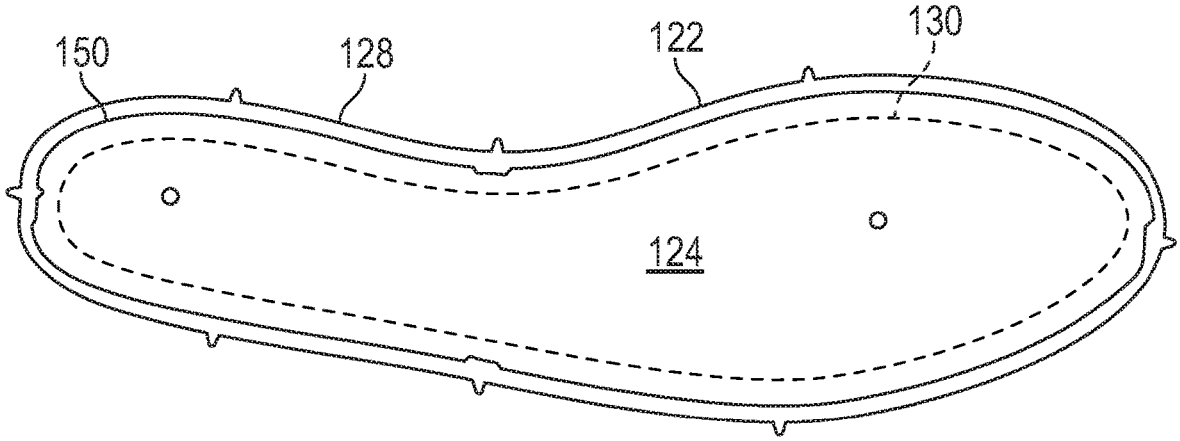
FIG. 4 is a top view of multipart strobel structure that includes an inner strobel on a transition strip.
Figure 5:
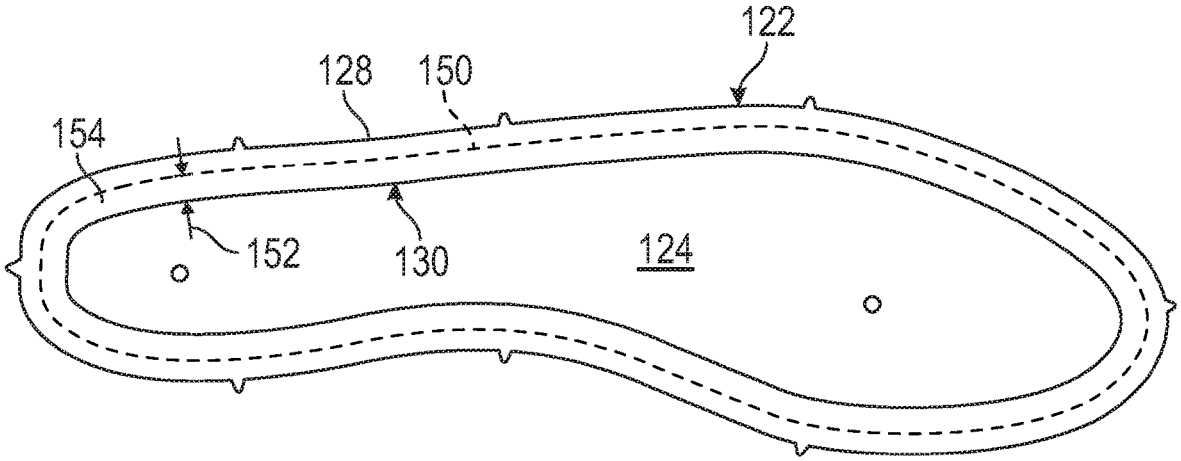
FIG. 5 is a bottom view of the multipart strobel structure of FIG. 4.

FIGS. 4 and 5 illustrate the overlap between an area adjacent the outer edge 150 of the inner strobel 124 with an area adjacent the inner perimeter edge 130 of the transition strip 122 in an exemplary embodiment. FIG. 4 shows a top view of an arrangement in which the inner strobel 124 is positioned on top of the transition strip 122, and FIG. 5 shows a bottom view of this same arrangement. A width 152 of the overlapping region 154 is less than the width w of the transition strip 122.

Figure 6:
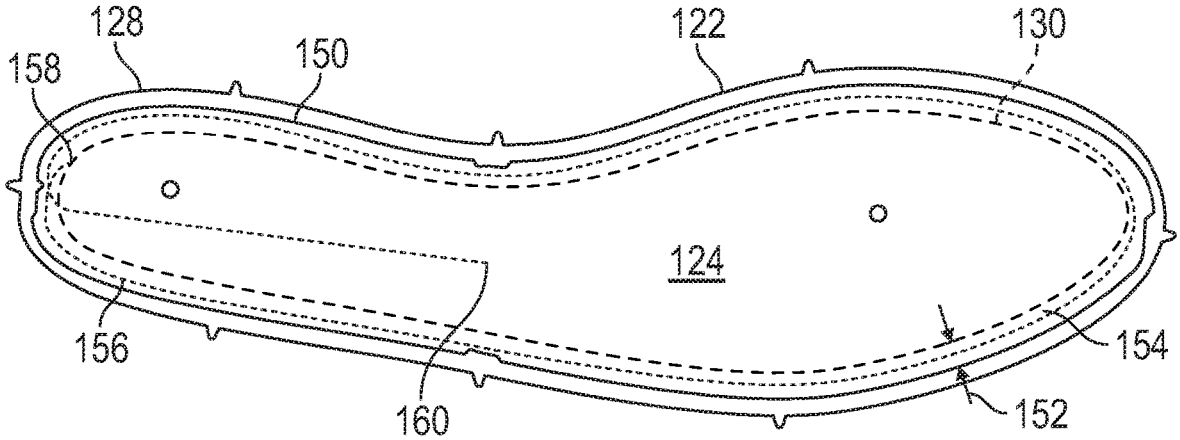
FIG. 6 illustrates the multipart strobel structure of FIG. 4, with a removable stitch securing the inner strobel to the transition strip.

As shown in FIG. 6, the inner strobel 124 can be temporarily fixed to the transition strip 122 by a removable stitch 156 in the overlapping region 154. Thus, the overlapping region 154 should be wide enough to receive a temporary attachment element (e.g., a removable stitch). The removable stitch 156 is of a type that can secure the two components together with sufficient strength to resist the forces that are applied during lasting. In some embodiments, removable stitch 156 can be a chain stitch that extends along the length of the overlapping region 154 as shown in FIG. 6.

Referring to FIG. 6, removable stitch 156 can begin at a location in the overlapping region 154, such as a first location (start point) 158, extend around along the length of the overlapping region 154, and end at a second location (end point) 160 on the inner strobel 124 outside of the overlapping region 154. The thread of the removable stitch 156 can have a free end at the second location 160, so that it can be more easily grasped for removal.

In some embodiments, the portion of the removable stitch 156 that extends around the length of the overlapping region can overlap with a beginning portion of the removable stitch in the vicinity of first location 158. A small amount of stitch overlap, as shown in FIG. 6, can help ensure that the inner strobel 124 is fully secured to the transition element. The amount of overlap can be 10 to 25 mm, 15 to 20 mm, or at least 15 mm in some embodiments. The thread can be any suitable thread, such as a 210 denier, 3 ply thread.

The removal of the removable stitch can be achieved by pulling on the end of thread (e.g., at the second location 60) and undoing the thread in reverse (i.e., by pulling the stitch out from the second location 160 to the first location 158).

Other temporary attachment techniques are possible. For example, a dissolvable thread can be used, such as a thread that dissolves in water. As in the chain stitching example, a dissolvable thread can hold the inner strobel 124 and transition strip 122 together with sufficient strength for lasting and, subsequently be dissolved to remove the inner strobel 122 as described in more detail below. Alternatively, or in addition, a bonding material can be used to temporarily secure the inner strobel 124 and transition strip 122. Preferably, to facilitate subsequent detachment of the inner strobel 124, the bonding material comprises an adhesive that forms a reversible bond. Depending on the particular adhesive material, the reversible bond can be deactivated by applying, for example, heat and/or a deactivating material (e.g., a deactivating solution).

In some cases, a ratio of the width 152 of the overlapping region 154 to the width w of the transition strip 122 can be from 0.25 to 0.85. In other embodiments, the ratio of the width 152 of the overlapping region 154 to the width w of the transition strip 122 is 0.30 to 0.50. For all ratios and ranges described herein, the disclosed range includes the endpoints of that range unless otherwise stated (e.g., a ratio between 0.30 and 0.50 includes both 0.30 and 0.50).

For example, the following table illustrates exemplary widths of the overlapping region and transition strip measured from the same area of the transition strip, including exemplary embodiments that fall within the 0.25-0.85 range and the 0.30-0.50 range.

| Example | Width (Overlapping Region) | Width (Transition Strip) | Ratio |
|---|---|---|---|
| 1 | 3 mm | 12 mm | .25 |
| 2 | 3 mm | 10 mm | .30 |
| 3 | 4 mm | 13 mm | .31 |
| 4 | 4 mm | 11 mm | .36 |
| 5 | 5 mm | 12 mm | .42 |
| 6 | 5 mm | 11 mm | .45 |
| 7 | 5 mm | 10 mm | .50 |
| 8 | 6 mm | 10 mm | .60 |
| 9 | 9 mm | 12 mm | .75 |
| 10 | 8.5 mm | 10 mm | .85 |

As noted above, the width w of the transition strip 122 can be substantially constant along the entire length of the transition strip 122 or, alternatively, it can vary if desired. Similarly, the width of the overlapping region can vary along the length of the overlapping region. Thus, for example, while the ratio may be within 0.25-0.85 for the entire length of an overlapping region, the ratio may vary at different points along the overlapping region, either by design or because of minor placement errors.

Figure 7:
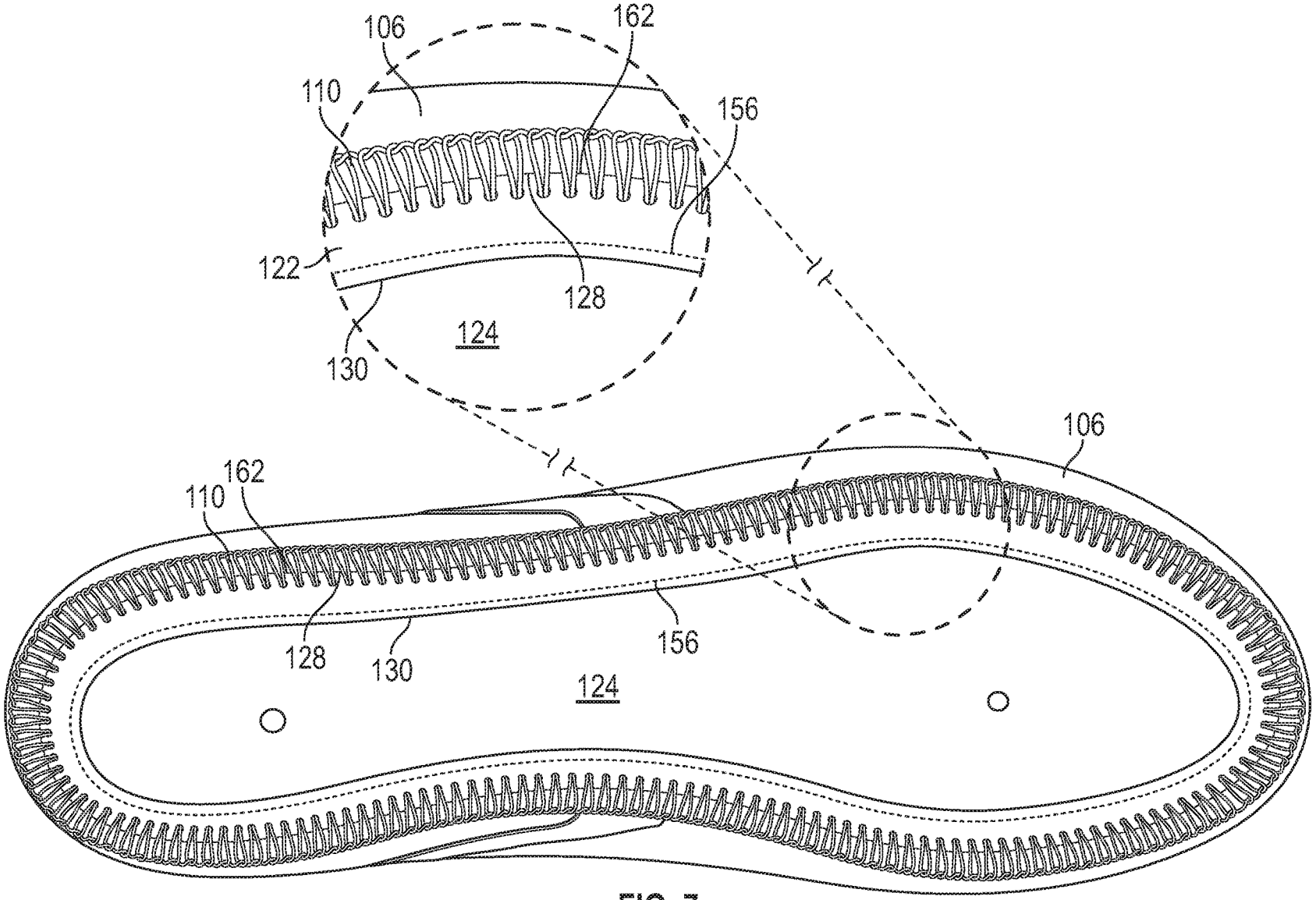
FIG. 7 is a bottom view of a multipart strobel structure secured to an upper.
Figure 8:
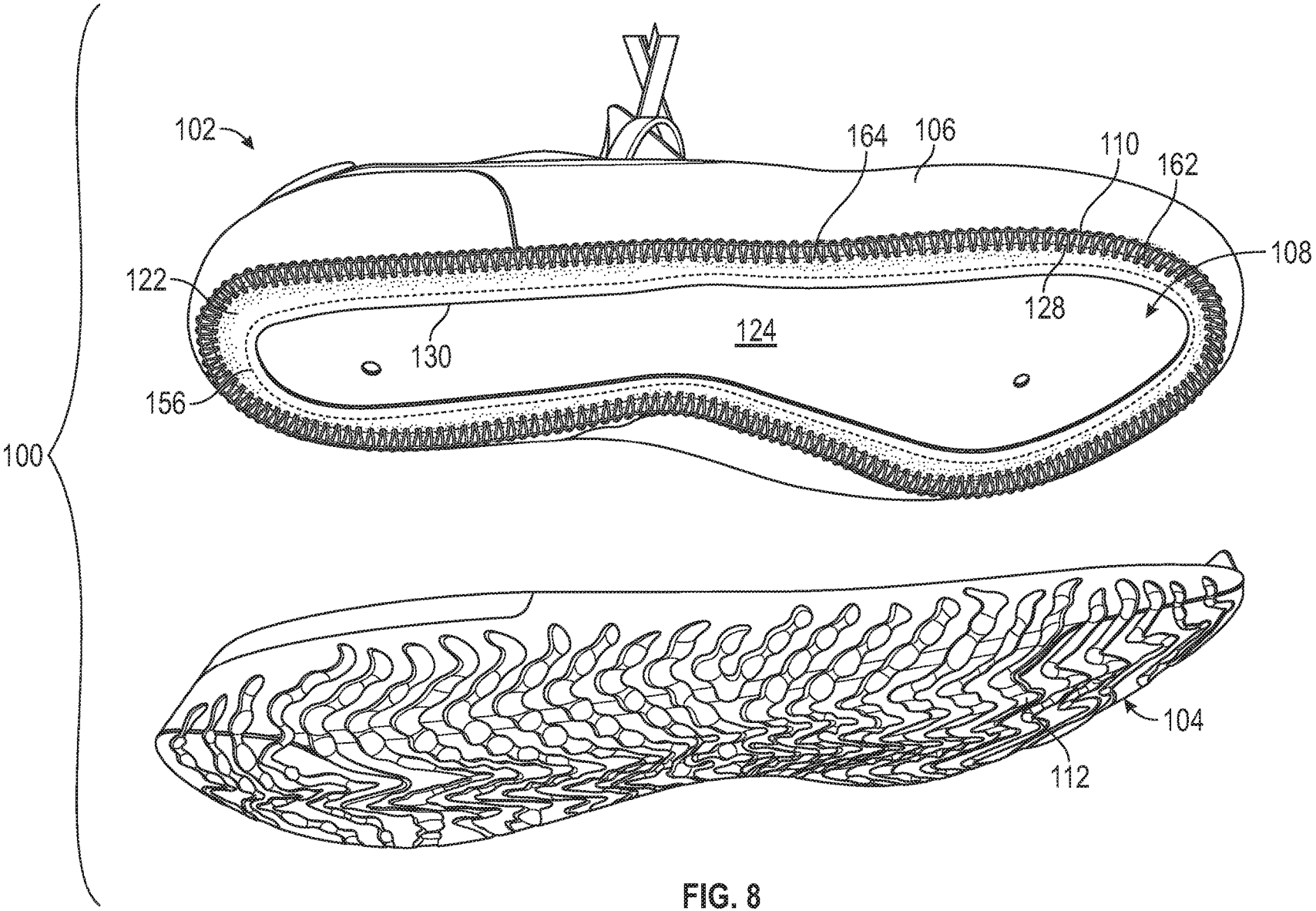
FIG. 8 is a perspective view of a lasted upper and a sole structure.

As shown in FIGS. 7 and 8, after the transition strip 122 and inner strobel 124 are coupled together (e.g., temporarily fixed) as described above, the multipart strobel structure 108 is secured to the upper 106. In the exemplary embodiment, strobel structure 108 is joined to upper 106 by stitching 110, which secures a lower edge 162 of upper 106 to the multipart strobel structure 108 along its outer perimeter. In particular, stitching 110 couples the lower edge 162 of upper 106 to the transition strip 122.

After the multipart strobel structure (transition strip 122 and inner strobel 124) is secured to the upper as shown in FIG. 7, the lasted upper 102 can be secured to the sole structure 104. As shown in FIG. 8 (and FIG. 2), a lower surface of the lasted upper 102 can be coupled to the upper surface 114 of the sole structure 104 to form the article of footwear 100. The lower surface of the lasted upper 102 can be secured to the sole structure 104 at an area outside of perimeter defined by the removable stitch 156. Thus, for example, the sole structure 104 can be engaged with the upper 106 at its bottom edges and at a portion of the transition strip 122 that is outside of the location of the removable stitch 156. The sole structure 104 can be secured to the upper and transition strip using a bonding material, such as cements or adhesives, and/or mechanical bonding techniques such as stitching or sewing, mechanical connectors, etc.

Figure 12:
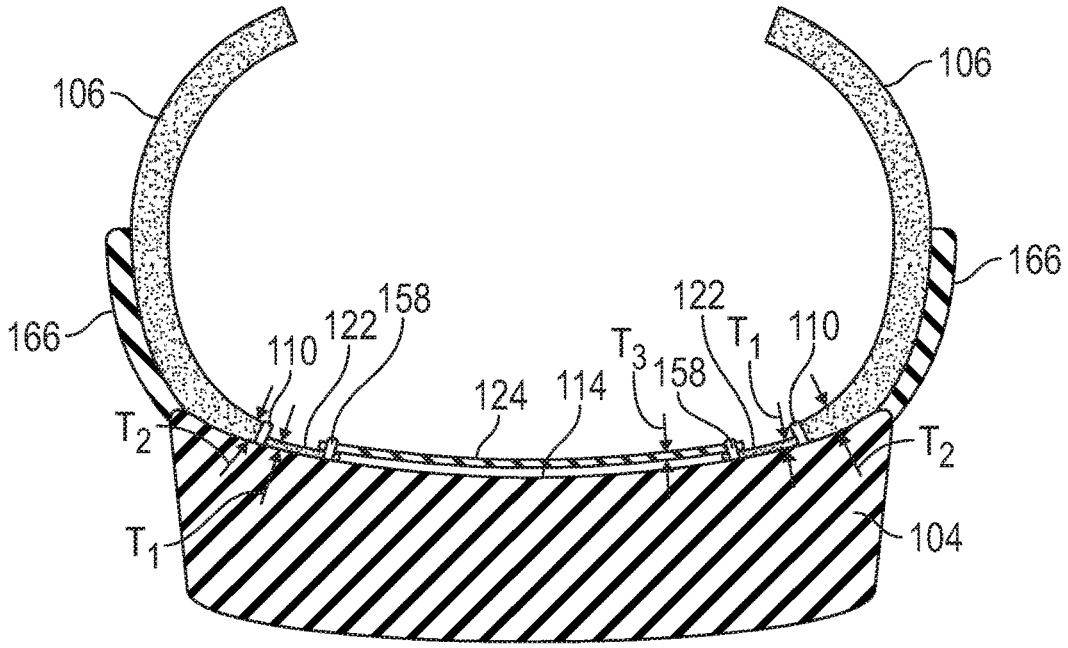
FIG. 12 is a cross-sectional view of the article of footwear shown in FIG. 9.

FIG. 8 shows a cement 164 applied to a bottom perimeter of the lasted upper 102 outside of the location of the removable stitch 156. In some embodiments, a bonding guide line can be provided on the lasted upper 102, such as along the transition strip 122 where it is stitched to the upper. As shown in FIG. 12, because the transition strip 122 has a stepped relationship with the inner strobel 124 (i.e., the transition strip has a bottom surface that is lower, relatively, than a bottom surface of the inner strobel), the step of applying a bonding material to the transition strip can more easily avoid applying the bonding material to the inner strobel.

Figure 9:
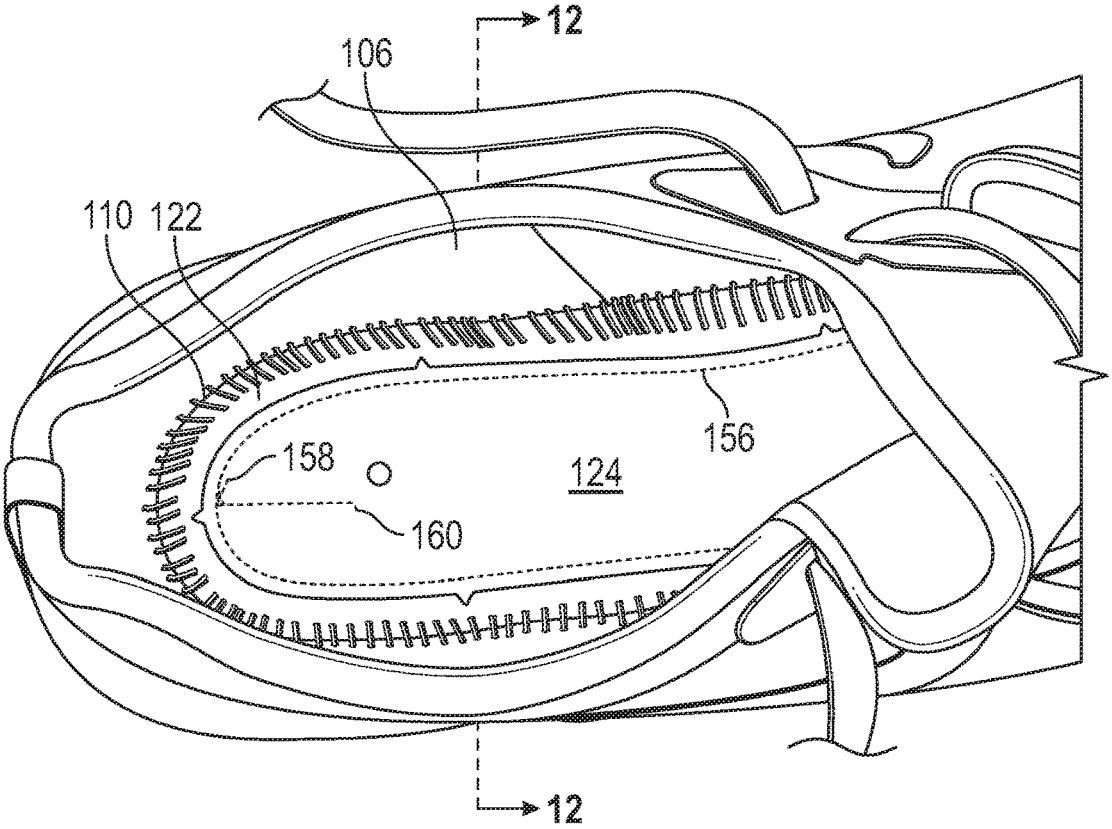
FIG. 9 is a top view of an article of footwear with a multipart strobel structure.

After securing the lasted upper 102 to the sole structure 104, the article of footwear can be removed from the last. FIG. 9 is a top view of the inside of the upper at the heel region of the article of footwear after it has been de-lasted. As shown in FIG. 9, the article of footwear is formed with the inner strobel 124 on top of the transition strip 122, so that an upwardly-facing surface of the inner strobel 124 is exposed and uncovered, while a portion of the upwardly-facing surface of the transition strip 122 is covered by a portion of the inner strobel 124 (i.e., the overlapping region 154).

Figure 10:
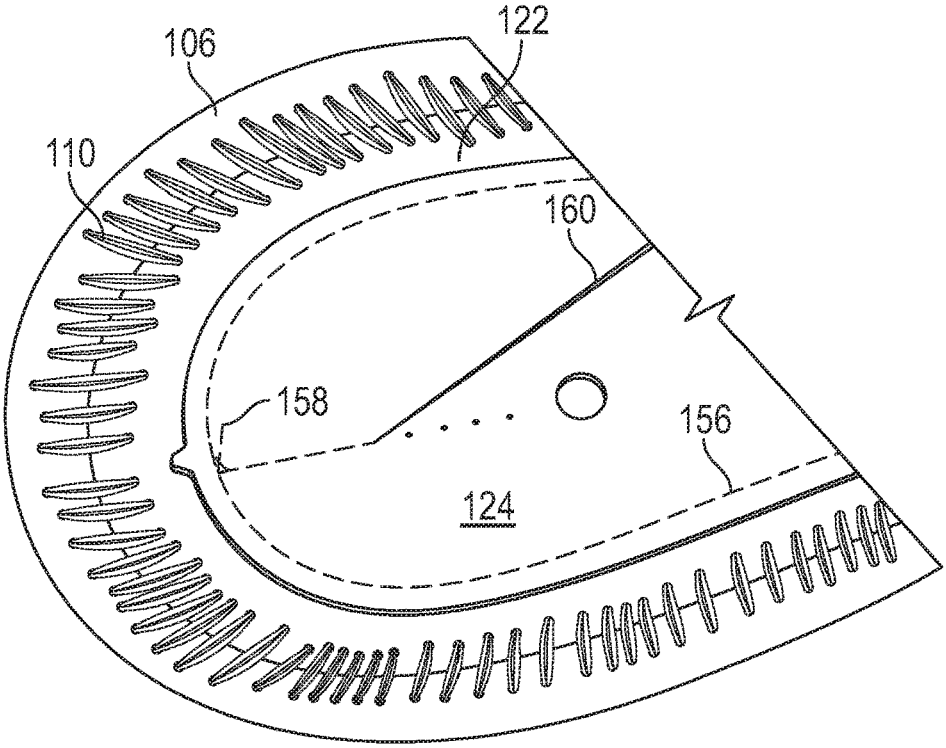
FIG. 10 is an enlarged view of the multipart strobel structure shown in FIG. 9.

FIG. 10 shows an enlarged view of the heel region of the upper shown in FIG. 9. An end of the removable stitch (e.g., the free portion of thread at end point 160) is pulled to begin removing the stitch. As the thread is pulled, the stitch is removed from the article of footwear and the inner strobel 124 is detached from the transition strip 122. The removal of the inner strobel 124 exposes the upper surface 114 of the sole structure 104, as shown in FIG. 11.

Figure 11:
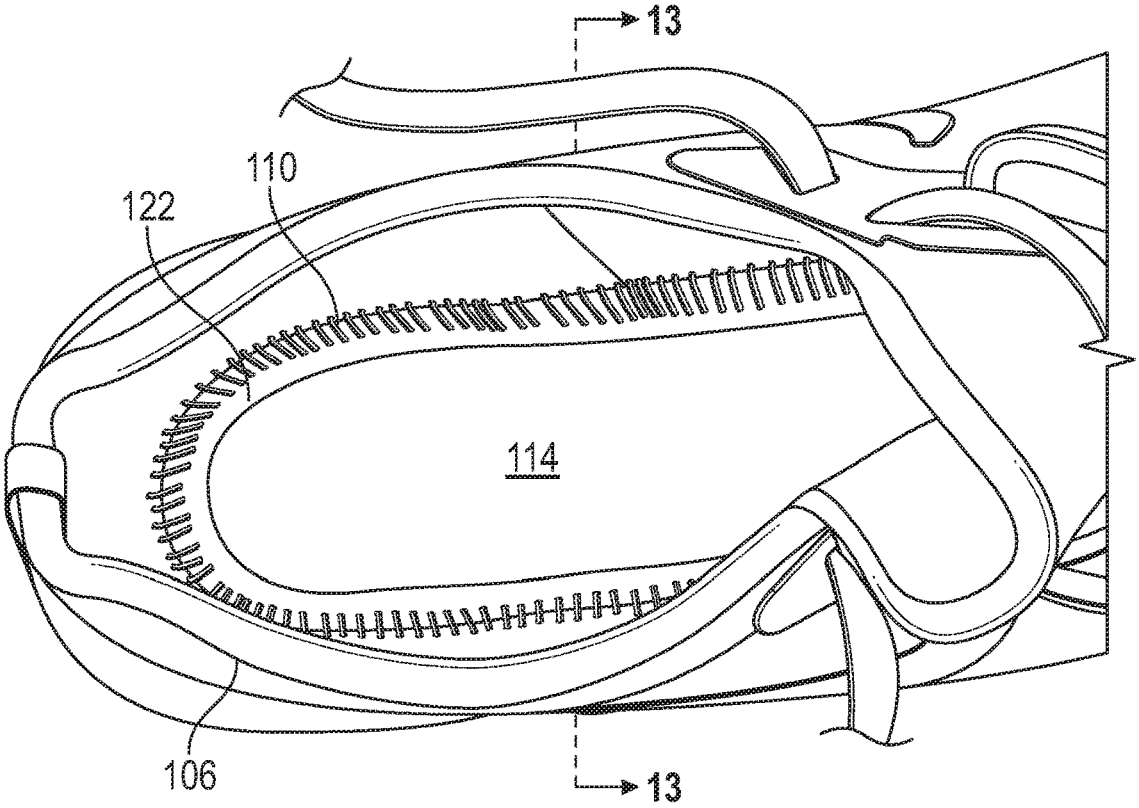
FIG. 11 is a top view of an article of footwear with a transition strip secured to an upper.
Figure 13:
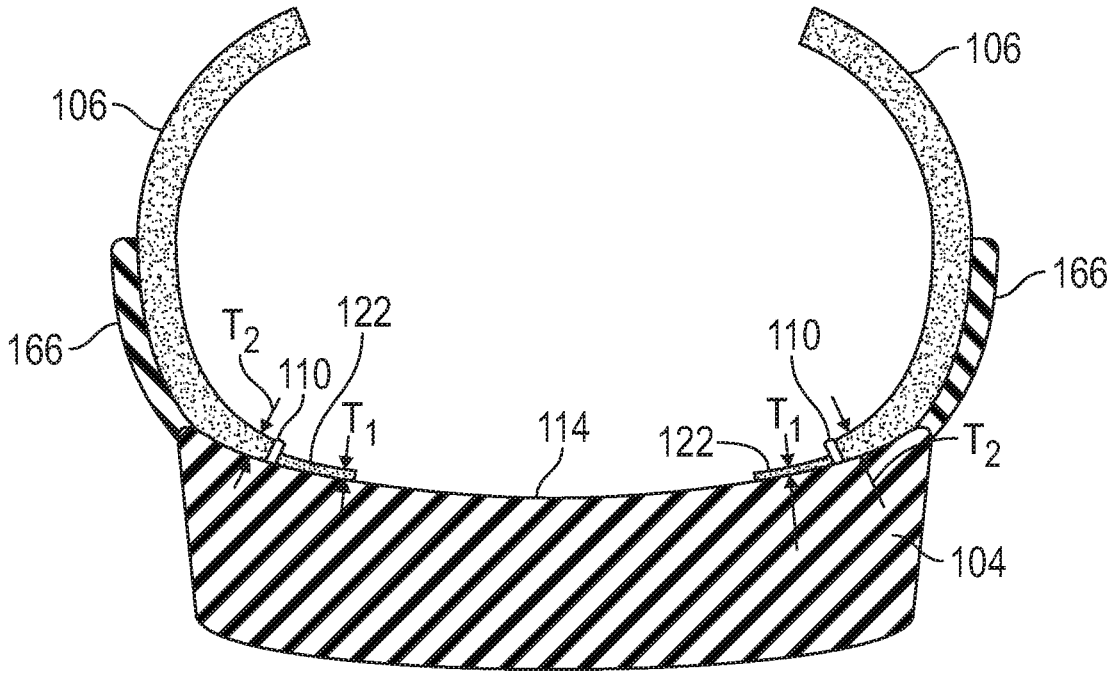
FIG. 13 is a cross-sectional view of the article of footwear shown in FIG. 11.

FIG. 12 is a cross-sectional view of taken along the line 12-12 in FIG. 9, and FIG. 13 is a cross-sectional view taken along the line 13-13 in FIG. 11. In FIG. 12, the inner strobel 124 is still attached to the transition strip 122, while in FIG. 13, the inner strobel 124 has been removed and the upper surface 114 of the sole structure is exposed.

As shown in FIGS. 12 and 13, transition strip 122 can have a thickness $T_1$ that is less than a thickness of the upper $T_2$ in a region where the upper 106 is secured to transition strip 122. The thickness of the inner strobel 124 is identified as $T_3$ in FIG. 12.

As discussed above, the thickness $T_1$ of the transition strip can be less than or equal to 1.2 mm, less than or equal to 1.0 mm, or less than or equal to 0.8 mm. In some embodiments, $T_1$ is smaller than $T_2$. For example, the ratio of $T_1/T_2$ can be equal to or less than 0.7 in some embodiments, equal to or less than 0.5 in some embodiments, or in some embodiments equal to or less than 0.3. In each of these embodiments, the ratio of $T_1/T_2$ can also be greater than or equal to 0.3, such as preferably between 0.3 and 0.6. In some embodiments, the thickness $T_3$ of the inner strobel 124 can be the same as that of the transition strip, so the same ratios can apply to the inner strobel.

For example, the following table illustrates exemplary thicknesses of the transition strip and upper adjacent the transition strip, and relationships thereto.

| Example | Transition Strip Thickness ($T_1$) | Upper Thickness Adjacent Transition Strip ($T_2$) | Ratio of $T_1/T_2$ |
|---|---|---|---|
| 1 | 1.2 mm | 1.7 mm | 0.7 |
| 2 | 1.0 mm | 1.67 mm | 0.6 |
| 3 | 0.8 mm | 1.6 mm | 0.5 |
| 4 | 0.6 mm | 1.5 mm | .4 |

-continued

| Example | Transition Strip Thickness ($T_1$) | Upper Thickness Adjacent Transition Strip ($T_2$) | Ratio of $T_1/T_2$ |
|---|---|---|---|
| 5 | 0.5 mm | 1.67 mm | .3 |
| 6 | .4 mm | 1.6 mm | 0.25 |
| 7 | .35 mm | 1.6 mm | 0.22 |

As discussed above, the sole structure 104 is secured to the bottom edges of the upper 106 and the transition strip 122, such as by cement. The sole structure 104 can cover the stitching 110, as shown in FIGS. 12 and 13. In addition, if desired a heel counter 166 or other surrounding structure can provide further support to the upper in the heel region and/or elsewhere.

Figure 14:
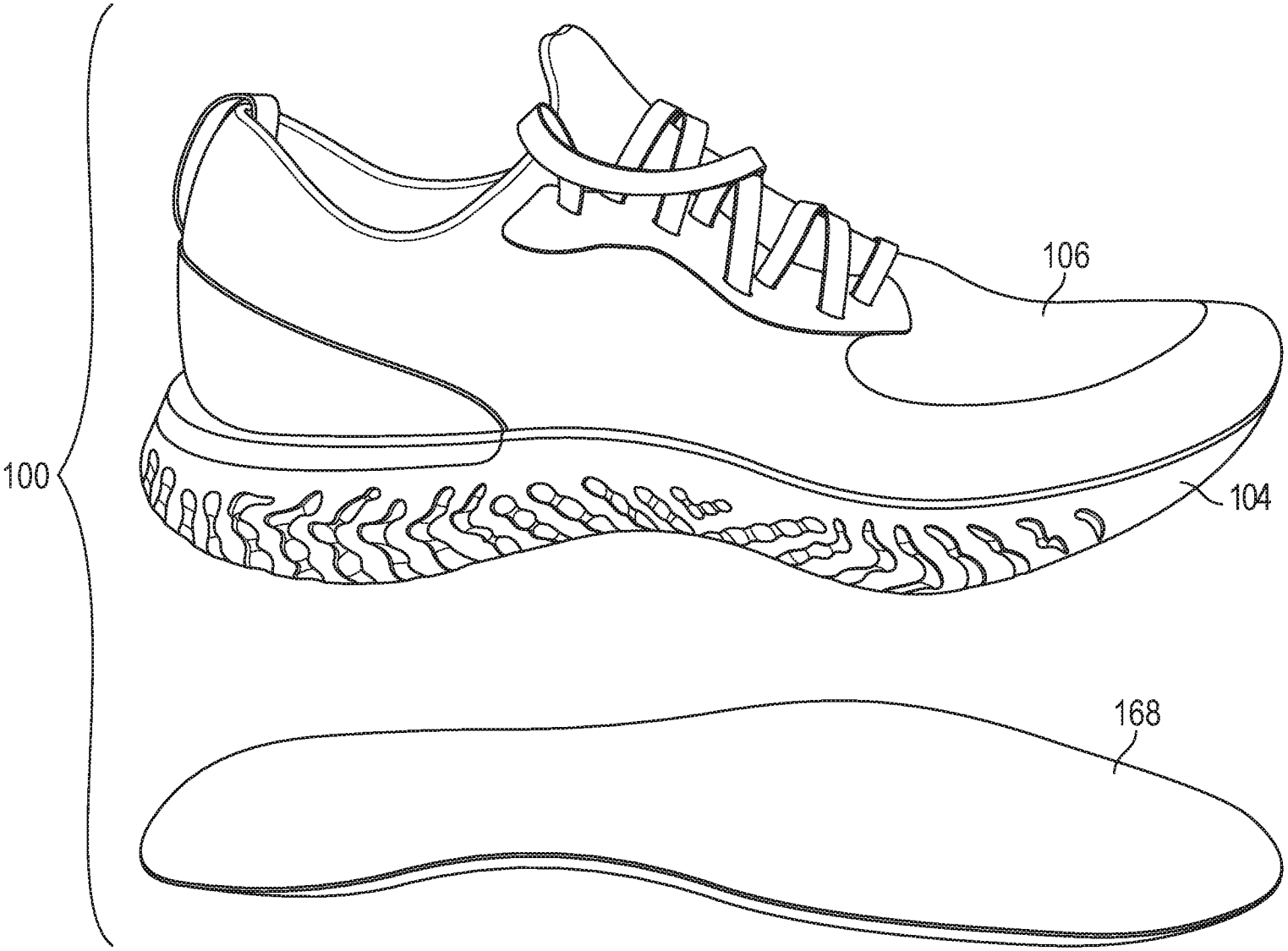
FIG. 14 illustrates an exemplary article of footwear and an insole.

In some embodiments, an insole, such as sockliner 168, can be provided within the void of the article of footwear 100 to provide additional support and/or cushioning. Sockliner 168 can comprise one or more layers of material and/or be formed in a unitary construction that can be placed inside the article of footwear. The sockliner can have a thickness $T_4$, which is greater than the thickness of the transition strip. In some embodiments, the sockliner is at least twice as thick as the transition strip, at least 3 times as thick as the transition strip, or at least four times as thick as the transition strip. As shown in FIG. 14, the sockliner 168 can be removable from the shoe.

Figure 15:
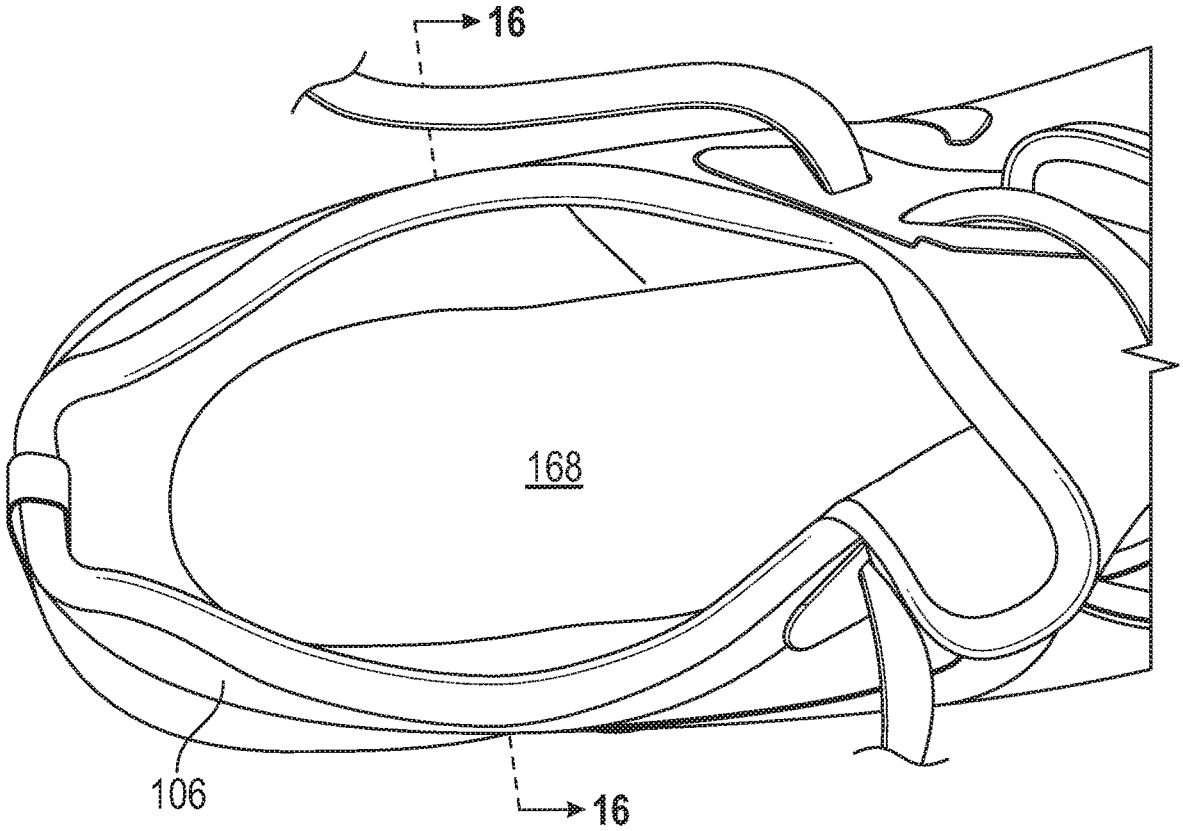
FIG. 15 is a top view of an article of footwear with an insole.
Figure 16:
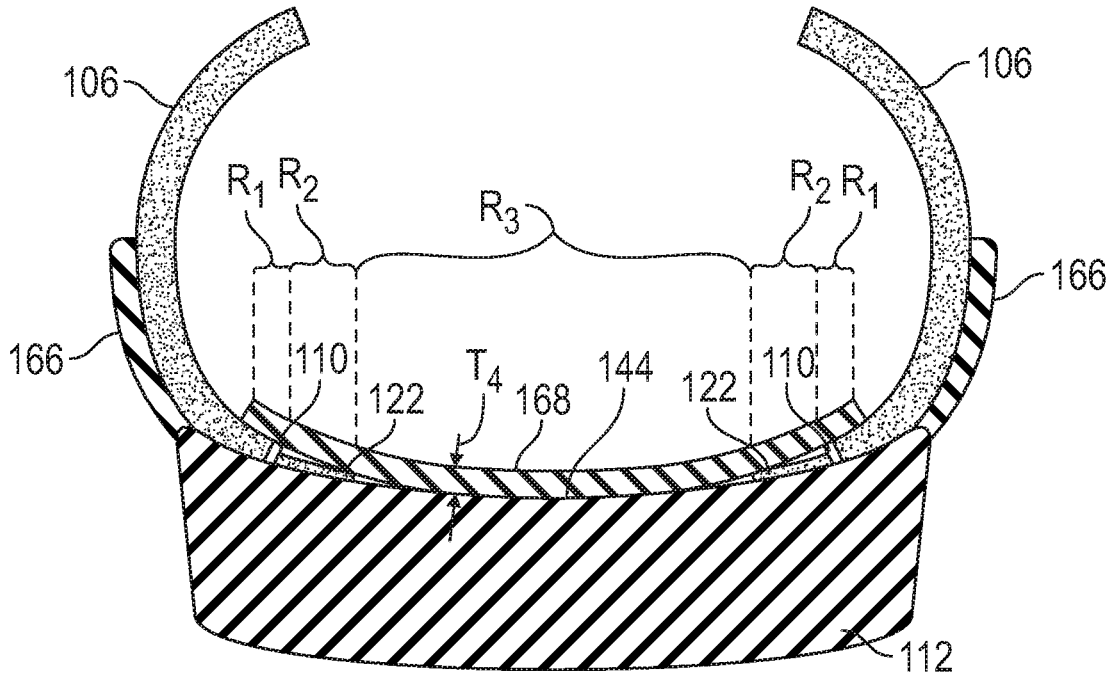
FIG. 16 is a cross-sectional view of the article of footwear shown in FIG. 15.

As shown in FIGS. 15 and 16, when a sockliner 168 is provided it rests directly on top of the sole structure and a portion of the transition strip 122. FIG. 15 shows a top view of the inside of the upper at the heel region of the article of footwear with sockliner 168 visible and obscuring the portions of the sole structure and transition strip below. FIG. 16 is a cross-sectional view taken along line 16-16 in FIG. 15, which illustrates the relationship between a bottom surface of sockliner 168 and an upper surface 114 of the sole structure 104 and an upper surface of the transition strip 122.

FIG. 16 illustrates the sockliner positioned directly above at least a portion of the upper surface 114 of the sole structure 104, without any intermediate structures, so that, in use, the sockliner will rest directly on the portion of the upper surface 114. This is illustrated in FIG. 16 as region $R_3$. Regions $R_1$ and $R_2$ illustrate, respectively, a region ($R_1$) where the sockliner overlaps with a lower portion of the upper 106 and a region ($R_2$) where the sockliner overlaps with the transition strip 122. As shown in FIG. 16, the sockliner can be flexible to curve to conform to the surfaces of the upper, transition strip and surface of the sole structure which it comes into contact with. In some embodiments, regions $R_1$ and $R_2$ can be significantly shorter (in the lateral-medial direction illustrated in FIG. 16) than region $R_3$. In this manner, region $R_3$ includes a much greater portion of the width of the sockliner (and, in turn, the foot of a user) than regions $R_1$ and $R_2$. In some embodiments, a width of region $R_3$, taken along a heel section, covers greater than 60% of a width of the sockliner at that same heel section. In other embodiments, the amount of coverage of region $R_3$ is greater than 70%, greater than 80%, or greater than 90% of the width of the sockliner. Similarly, in some embodiments, the combined width of regions $R_1$ and $R_2$ is less than 30%, less than 20%, or less than 10% of the width of the sockliner.

FIG. 16 illustrates a slight gap between a bottom of the sockliner 168 and certain portions of the upper surface 114 of the sole structure 104 (i.e., immediately adjacent the transition strip). The term immediately adjacent, in this context, refers to a portion of the upper that is directly next to the stitching 110. This portion will generally also overlap with a sockliner (e.g., region $R_1$). Another way to calculate this thickness would be by measuring the thickest portion of the upper in the region $R_1$. Depending on the thickness of the transition strip and shape of the sockliner, this gap can be reduced further and/or eliminated entirely. In addition, when a downward force is applied (e.g., the user's foot) to the sockliner, any gap that may exist would be further reduced and/or eliminated by the downward force.

Thus, in some embodiments, the methods and structures described herein provide an article of footwear that reduces the number of layers—and in some embodiments the thickness of the layers—that are positioned between a user's foot and the sole structure. This arrangement can provide improved comfort and reduce the overall weight of the article of footwear.

Also, as shown in FIG. 16, the structures beneath the sockliner can provide a gradient resulting from a changing thickness of the material (or lack of material) resting on and/or fixed to upper surface 114 of the sole structure. In particular, the thickness of these materials are gradually reduced to provide a smooth transition for the sockliner. For example, region $R_1$ can have a greater thickness between the upper surface 114 and sockliner ($T_2$ of upper) than $R_2$ or $R_3$. $R_2$ can have a greater thickness between the surface 114 and sockliner ($T_1$ of transition strip) than $R_3$, which has no material (e.g., zero thickness of material) between the sockliner and the upper surface. The gradient created by $R_1$, $R_2$, and $R_3$ can provide an improved comfort fit by gradually sloping the sockliner to a preferred condition in which the sockliner rests directly on the upper surface 114 of the sole structure as shown in FIG. 16.

Figure 17:
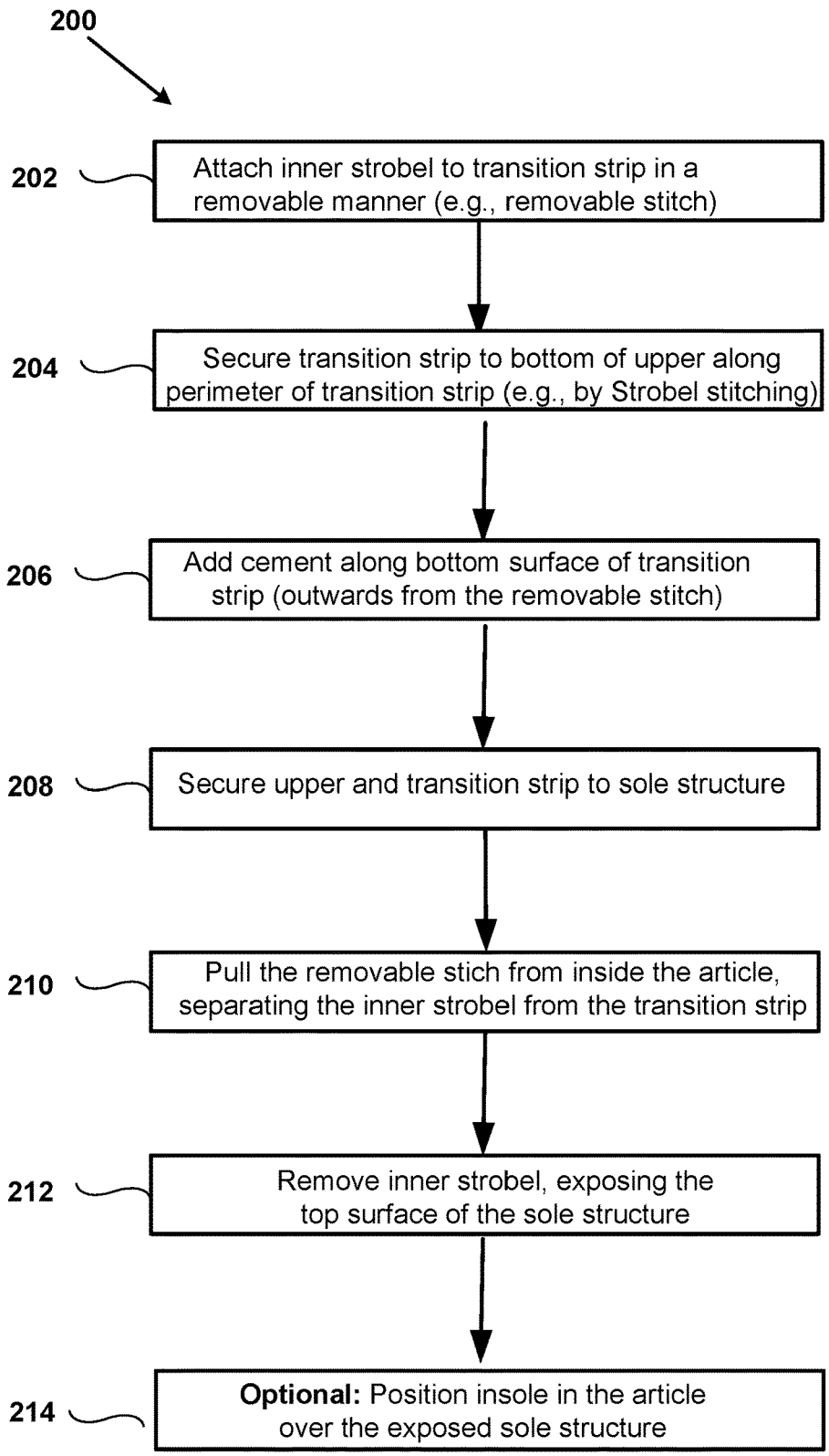
FIG. 17 depicts an exemplary flow chart outlining an exemplary method for assembling an article of footwear as described herein.

FIG. 17 illustrates depicts an exemplary method 200 for assembling an article of footwear 100 by forming a multipart strobel structure and removing a portion of that structure after lasting and coupling to a sole structure. The method 200 can comprise attaching an inner strobel 124 to a transition strip 122 in a removable manner, such as with thread and a removable stitch (process block 202). The transition strip 122 can then be secured to a bottom of an upper along its lower perimeter edge, such as by Strobel stitching (process block 204).

Cement, or other bonding materials, can be applied to the bottom surface of the transition strip 122 (process block 206). In some embodiments, a mechanical bonding method can be used, alternatively or in addition to the bonding material. The bonding material (e.g., cement) is preferably applied toward the outer perimeter edge of the transition strip 122 to avoid contacting the thread of the removable stitch which may impeded subsequent removal of the inner strobel 124.

After the multipart strobel structure is formed and the bonding material added, the upper 106 and transition strip 122 can be secured to the sole structure (process block 208). This can occur while the upper 106 is on a last, such as last 101 shown in FIG. 1. After the sole structure is secured to the upper 106 and transition strip 122, the article of footwear can be de-lasted. The inner strobel 124 can then be removed by pulling the removable stitch from inside the upper and separating the inner strobel from the transition strip (process block 210) and removing the inner strobel 124 to expose the upper surface 114 of the sole structure 104 (process block 212). If desired, an optional insole member (e.g., a sockliner 168) can be positioned over the exposed sole structure (process block 214).

Figure 18:
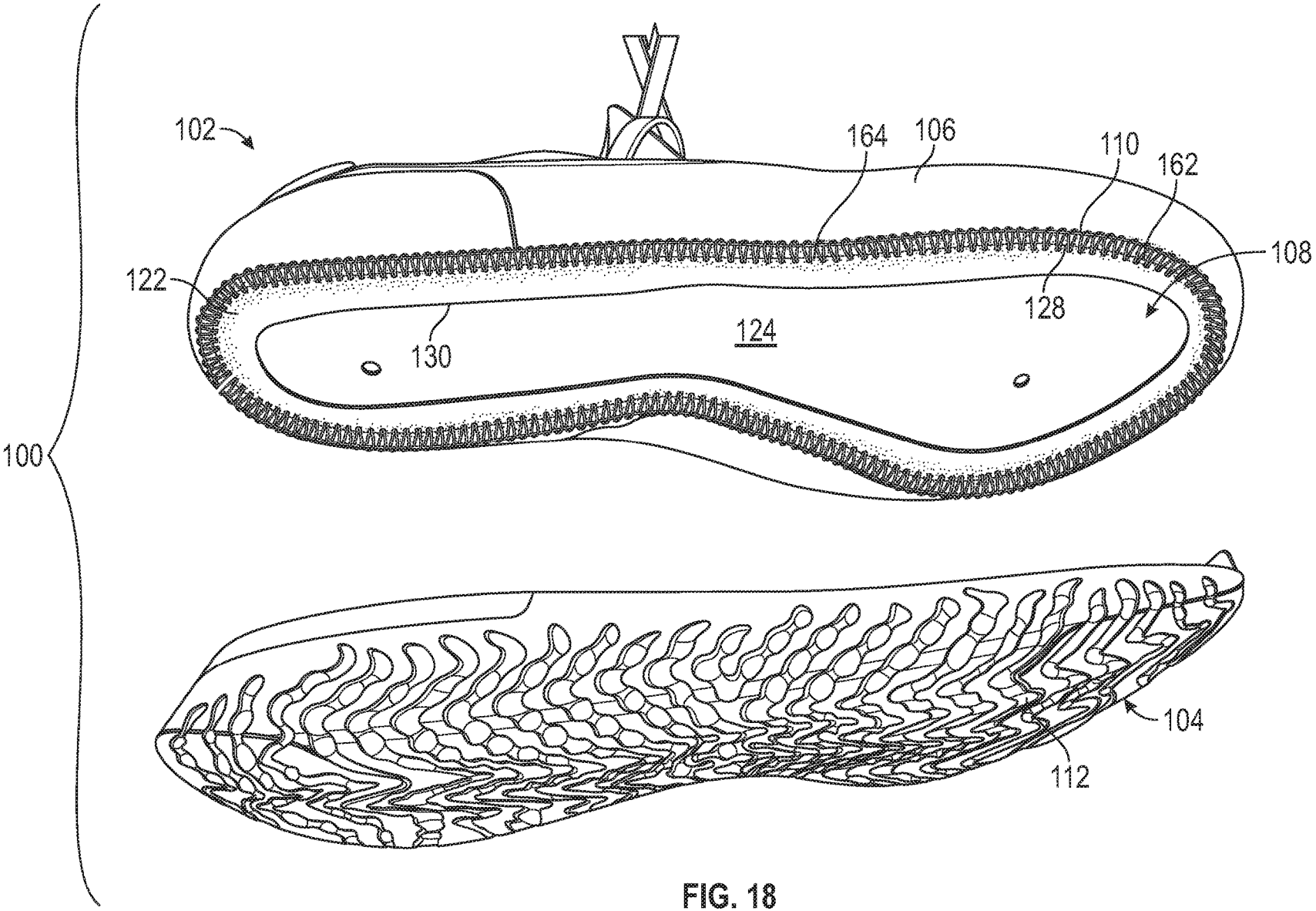
FIG. 18 is a perspective view of a lasted upper and a sole structure in which a bonding material temporarily attaches the inner strobel to the transition strip.

As discussed above, in some embodiments a temporary adhesive can be used in addition to, or instead of, a temporary stitch. In embodiments where only a temporary adhesive (e.g., an adhesive that can form a reversible bond) is used to secure the inner strobel to the transition strip, there would be no stitching between the inner strobel and transition element. FIG. 18 illustrates an embodiment that is similar to that shown in FIG. 8, but where the temporary attachment is achieved by providing a bonding material in the overlapping region, instead of a removable stitch.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A method of forming of an article of footwear, comprising:

providing a closed transition strip that has an outer perimeter edge, an inner perimeter edge, and a width between the outer perimeter edge and the inner perimeter edge, the inner perimeter edge defining an internal opening of the closed transition strip;

providing an inner strobel that has an outer perimeter edge;

positioning the inner strobel in an overlapping relationship with the closed transition strip to provide an overlapping region between the outer perimeter edge of the inner strobel and the inner perimeter edge of the closed transition strip, and a non-overlapping region that extends from an outside boundary of the overlapping region to the outer perimeter edge of the closed transition strip;

temporarily attaching the inner strobel to the closed transition strip at the overlapping region;

positioning the closed transition strip so that both the closed transition strip and the inner strobel extend along a bottom portion of an upper from a forefoot region of the upper to a heel region of the upper;

securing the closed transition strip to the bottom portion of the upper, the closed transition strip being attached to the upper at the non-overlapping region and with the inner strobel facing an inner portion of the upper;

fixedly attaching the closed transition strip and bottom portion of the upper to a sole structure; and then separating the inner strobel from the closed transition strip and removing it from the inner portion of the upper.

2. The method of claim 1, wherein the closed transition strip has a first width at a first location along its length and the overlapping region has a second width at the first location, and a ratio of the second width to the first width is between 0.25 and 0.85.

3. The method of claim 1, wherein the closed transition strip has a first width at a first location along its length and the overlapping region has a second width at the first location, and a ratio of the second width to the first width is between 0.30 and 0.50.

4. The method of claim 1, wherein the width of the closed transition strip is substantially constant along a length of the closed transition strip.

5. The method of claim 1, wherein the width of the closed transition strip varies along a length of the closed transition strip.

6. The method of claim 1, wherein the width of the closed transition strip is between 6 mm and 15 mm.

7. The method of claim 1, wherein the width of the closed transition strip is between 8 and 13 mm.

8. The method of claim 1, wherein the width of the closed transition strip is between 10.5 and 12 mm.

9. The method of claim 1, wherein the inner strobel is temporarily attached to the closed transition strip with one or more threads using a removable stitch.

10. The method of claim 9, wherein the removable stitch is a chain stitch.

11. The method of either of claim 9, wherein separating the inner strobel from the closed transition strip comprises removing the one or more threads from the inner strobel.

12. The method of claim 1, wherein the inner strobel and the closed transition strip are formed of a generally non-stretchable material.

13. The method of claim 1, wherein the closed transition strip is secured to the bottom portion of the upper by stitching the bottom portion of the upper to an area adjacent the outer perimeter edge of the closed transition strip.

14. The method of claim 1, wherein fixedly attaching the closed transition strip and bottom portion of the upper to the sole structure comprises:

applying a bonding material at an attachment area, the attachment area including a location where the closed transition strip is secured to a bottom portion of an upper; and contacting the bonding material with an upper surface of the sole structure to secure the upper and the closed transition strip to the sole structure, wherein the attachment area does not include an area of the overlapping region where the inner strobel is temporarily attached the closed transition strip.

15. The method of claim 1, wherein the closed transition strip has a first thickness and a portion of the upper immediately adjacent to the closed transition strip has a second thickness, and a ratio of the first thickness to the second thickness is equal or less than 0.7.

16. The method of claim 1, wherein the closed transition strip has a first thickness and a portion of the upper immediately adjacent to the closed transition strip has a second thickness, and a ratio of the first thickness to the second thickness is between 0.3 and 0.6.

17. The method of claim 1, further comprising removing the upper from a last before separating the inner strobel from the closed transition strip and removing it from the inner portion of the upper, wherein the act of removing the upper from the last exposes a top surface of the inner strobel.

* * * * *